United States Patent [19]

Spataro

[11] 4,261,789

[45] Apr. 14, 1981

[54] DEVICE FOR APPLYING A SHEET-LIKE MATERIAL TO A SURFACE

[76] Inventor: Salvator Spataro, 44 The Boulevard, Morwell, Vic. 3840, France

[21] Appl. No.: 44,870

[22] Filed: Jun. 4, 1979

[30] Foreign Application Priority Data

Apr. 12, 1979 [AU] Australia ..... 46090/79

[51] Int. Cl.[3] ..... B44C 7/06

[52] U.S. Cl. ..... 156/576; 156/577; 156/579

[58] Field of Search ..... 156/574, 575, 576, 577, 156/579, 523, 527, 538, 539

[56] References Cited

U.S. PATENT DOCUMENTS

| | | | |
|---|---|---|---|
| 387,792 | 8/1888 | McAfee | 156/576 |
| 1,058,185 | 4/1913 | Krondak | 156/576 |
| 2,097,660 | 11/1937 | Gordon | 156/576 |
| 2,511,040 | 6/1950 | Boone | 156/576 |
| 2,594,835 | 4/1952 | Wornstaff | 156/576 |
| 2,696,320 | 12/1954 | Johnson | 156/577 |
| 2,711,263 | 6/1955 | Parsons | 156/577 |
| 4,072,547 | 2/1978 | Paunica | 156/576 |

*Primary Examiner*—Michael G. Wityshyn
*Attorney, Agent, or Firm*—Mattern, Ware, Davis & Stoltz

[57] ABSTRACT

A device for applying paper to a wall is disclosed which has a clamp member, a carriage and an actuator. The clamp member is formed of two elongate members for holding the paper therebetween and the carriage is formed of two pairs of wire members which hold a supply of the paper. One end of each pair of wire members is connected to one of the clamp members. The actuator is in the form of a hinge having two parts and includes a handle. The other end of each pair of wire members is connected to each part of the hinge so that the handle may be used to actuate the hinge to swing one pair of wire members relative to the other to open the clamp members and allow paper to be drawn therebetween.

11 Claims, 1 Drawing Figure

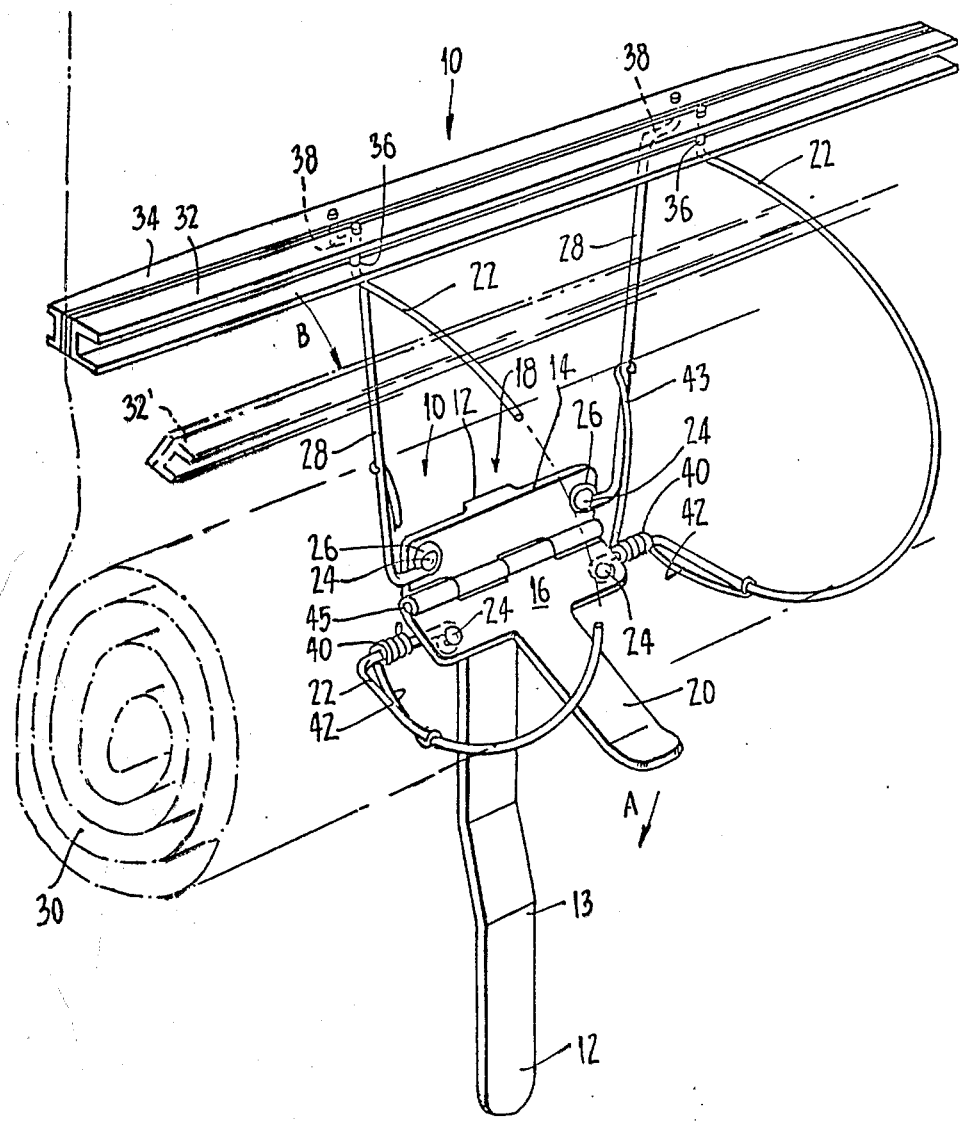
10
38
38
36
36
22
34
32
28
22
B
18
14
43
32'
10
12
26
24
28
40
42
26
24
16
45
24
24
40
22
20
42
A
30
13
12

DEVICE FOR APPLYING A SHEET-LIKE MATERIAL TO A SURFACE

This invention relates to a device for applying a sheet-like material to a surface and more particularly to a device for applying wall paper to a wall.

Conventional techniques for applying wall paper to a wall generally comprise the steps of applying glue to the wall paper or wetting down pre-glued wall paper and unrolling the wall paper. The paper is then placed against the wall whilst attempting to correctly align the paper so that the edges of the paper are vertical and so that any pattern on the paper will match a previous strip of wall paper which has been placed on the wall.

Further, the paper is usually applied to the wall in strips which extend the length of the wall. Such strips are extremely difficult to manouvre and align and accordingly at least two people are generally required to support the paper and correctly align and apply the paper to the wall.

Even when two people assist with the application of the wall paper the job is still difficult due to the small area in which the people must work to apply the paper to the wall with the result that the paper may be incorrectly aligned. This is extremely disadvantageous since most wall paper is applied to a wall with quick-drying glue and it may therefore not be possible to correct the position of a strip of paper which has not been correctly aligned. Accordingly, it may be necessary to strip the incorrectly aligned paper from the wall which increases the cost of wallpapering a wall.

It is therefore desirable to provide a device for applying wall paper to a wall (or indeed any sheet-like material to a surface) which would allow the paper to be applied correctly and conveniently by one person.

The present invention therefore provides a device for applying a sheet-like material to a surface comprising a carriage for holding the sheet-like material and clamp means for gripping the sheet-like material, said device having control means for selectively engaging and disengaging the clamp means from said material such that said material may be drawn through the clamp means when the clamp means is disengaged from the material.

This arrangement allows the sheet material such as wall paper, hereinafter termed "paper", to be carried in the carriage. A small amount of glued paper may be drawn from the paper in the carriage between the clamp means when the clamp means is in the disengaged condition. The claim means may then be re-engaged with the paper and the paper together with the clamp means may be allowed to hang freely while the user correctly positions the small amount of paper on the wall. Once this has been achieved the clamp is disengaged from the paper and about 1 meter of the paper is drawn through the clamp means which is then re-engaged with the paper. The device may then be removed and this small amount of paper is applied to the wall together with the remainder of the complete strip of paper.

Preferably, the carriage comprises two pair of opposed wire members, one of said pair of members being substantially linear and the other pair being semi-circular. Preferably, the clamp means comprises a pair of clamp members, one of said clamp members being secured to one end of each of said pair of opposed wire members.

Preferably, the control means for allowing selective engagement or disengagement of the clamp means is a spring based hinge connected to the other end of the pair of opposed wire members. A preferred embodiment of the invention is hereinafter described with reference to the accompanying drawing which is a perspective view of a device for applying wall paper. In the figure, the device 10 for applying wall paper to a wall comprises a handle 12 securely connected to one portion 14 of a hinge 18. The other portion 16 of the hinge 18 has a trigger 20. The portion 16 of hinge 18 also supports a pair of seim-circular wire members 22. The wire members 22 may be connected to the portion 16 by rivets 24 which pass through loops 26 formed in end portions of the wire members 22.

The handle 12 has a raised portion 13 which allows the device 10 to be easily held against a wall.

Hinge portion 14 also supports a pair of substantially linear wire members 28. The linear wire members 28 may be connected to the hinge portion 14 in the same manner as the wire members 22 are connected to hinge portion 16.

The two pair of wire members 22 and 28 which are in opposed relationships form a carriage for holding a sheet of wall paper 30.

The ends 36 and 38 of each pair of wire members 22 and 28 remote from the hinge 18 are connected to a clamp member 32 and 34 respectively. The ends 36 of the wire members 22 are bent at right angles and are passed through holes in the clamp member 32. This enables the clamp member 32 to sit securely on wire members 22.

Similarly, the ends 38 of wire member 28 are cranked into stepped portions and are entered into holes in the clamp member 34 with the clamp member 34 sitting on the stepped portions of ends 38. The clamp members 32 and 34 are therefore securely connected to the wire members 22 and 28.

Preferably, the clamp members 32 and 34 are in the form of elongated bars and are about 50 cm in length. The wires in each of the pairs of wires 22 and 28 are separated by a distance of 14 cm and are located about 8 cm from the ends of the clamp members 32 and 34.

The opposed wire members 22 and 28 are connected to each other by two springs 40 which are wound about each one of the wire members 22 adjacent the ends connected to hinge portion 16. Each spring 40 has arms 42 and 43 which are securely connected with the wire members 22 and 28 respectively to bias the wire members 22 and 28 together, which in turn, holds the clamp members 32 and 34 tightly together.

In use, the sheet of wall paper 30 is placed in the carriage formed by the pairs of wire members 22 and 28 by either inserting the roll from one end of the carriage or disengaging the clamp means 32 and 34 and placing the roll 30 in the carriage through the space between them. To disengage the clamp members 32 and 34, the trigger 20 is drawn in the direction of arrow A towards handle 12 which rotates hinge portion 16 about hinge pivot 45 which in turn draws clamp member 32 in the direction of arrow B to the position indicated by reference numeral 32'.

Once the roll of wall paper 30 has been positioned in the carriage the clamp members 32 and 34 are disengaged in the manner disclosed above and a small amount of wall paper 30 is drawn from the roll between the clamp members 32 and 34. The trigger 20 is then released so that the clamp members 32 and 34 are biased tightened together to clamp the wall paper therebetween. The sheet 30 located in the carriage together with the device 10 is then allowed to hang freely while the user's hands are left free to correctly position the small amount of wall paper on the wall. Once this has been achieved the clamp members 32 and 34 are again disengaged and the device 10 is moved downwardly such that a further small amount of paper is drawn between the clamp members 32 and 34 from the sheet 20.

The trigger 20 is once again released to clamp the paper and this further small amount of paper is applied to the wall. The device 10 may then be removed or the remainder of the sheet applied to the wall.

Advantageously, the sheet 30 is cut into strips which have been measured to suit the height of the wall.

In an alternative embodiment the clamp members 32 and 34 may be opposed L-shaped members and the carriage may be connected to the clamps by welding. Indeed welding may replace all the rivets shown in the drawings.

An advantage of the present invention is that it allows a single person to apply wall paper to a wall conveniently and accurately. Further, by means of the present device, a user may use two hands to correctly position in turn small amounts of a strip of wall paper on the wall which is much easier that attempting to correctly position an entire strip to the wall in the one instance.

I claim:

1. A device for applying a sheet-like material to a surface comprising:

a carriage for holding the sheet-like material, a clamp means including a first and second clamp member for gripping the sheet-like material therebetween, said carriage having a first portion connected with one of said clamp members and a second portion connected with the other of said clamp members, and an actuating means including a first portion and a second portion, said portions of the actuating means being relatively movable, said first portion of the carriage also being connected with the first portion of the actuating means and the second portion of the carriage also being connected with the second portion of the actuating means, said actuating means including handle means for selectively moving the first portion of the actuating means relative to the second portion of the actuating means to swing the first portion of the carriage relative to the second portion of the carriage to thereby selectively engage or disengage the clamp means from the sheet-like material to allow the material, in use, to be drawn through the clamp means when the clamp means is disengaged from the material.

2. A device according to claim 1 wherein said carriage comprises two pairs of opposed wire members and said first portion of the carriage comprises one of said pair of wire members which are substantially linear and said second portion of the carriage comprises the other pair of wire members which are semi-circular.

3. A device according to claim 2 wherein said actuating means is a spring biased hinge, said spring biased hinge biasing the first and second portion of the carriage together to hold the clamp members tightly together.

4. A device according to claim 2 wherein said pair of semi-circular wire members have right angle bends at one end thereof, one of said pair of clamp members having holes therein for receiving the ends of said pair of semi-circular wire members to thereby secure the clamp member to the wire member.

5. A device according to claim 4 wherin said pair of substantially linear members have stepped ends, the other of said pair of clamp members having holes for receiving the ends of said pair of linear wire members.

6. A device according to claim 1 wherein the first and second portions of the carriage each comprise a pair of wire members connecting a respective portion of the actuating means to each respective clamp member, said actuating means being a spring biased hinge, wherein the spring bias is provided by a pair of springs coiled about each wire member of one of the two pairs of wire members adjacent ends of the hinge means, said spring having a pair of arms which are connected with a biased wire member in each pair of wire members.

7. A device according to claim 1 wherein said clamp members are elongate clamp members.

8. A device according to claim 1 wherein said handle means is a handle connected to one of the portions of the actuating means and the other portion of the actuating means has a trigger connected thereto, said portions of the actuating means generally being biased into a position in which the clamp members are clamped together, said trigger being movable towards said handle against the bias of the actuating means to cause engagement and disengagement of the clamp members.

9. A device according to claim 1 wherein a roll of sheet-like material is located in said carriage between the first and second portions of the carriage and an end thereof is biased between the clamp members to be selectively engaged and disengaged by the clamp members.

10. A device according to claim 1 wherein said clamp members are two opposed L-shaped members and the carriage is connected to the clamp members by welding.

11. A device according to claim 1 wherein said device is for applying wallpaper to a wall and said sheet-like material is wallpaper.

* * * * *